US011125228B2

(12) United States Patent
Staedele et al.

(10) Patent No.: US 11,125,228 B2
(45) Date of Patent: Sep. 21, 2021

(54) PUMP INCLUDING A ROTOR AND A PLURALITY OF BLOCKING DEVICE ELEMENTS FOR BLOCKING A PUMP DUCT

(71) Applicant: Watson Marlow GmbH, Rommerskirchen (DE)

(72) Inventors: Achim Staedele, Unterheinriet (DE); Eric Mayer, Heilbronn (DE)

(73) Assignee: Watson Marlow GmbH, Rommerskirchen (DE)

( * ) Notice: Subject to any disclaimer, the term of this patent is extended or adjusted under 35 U.S.C. 154(b) by 270 days.

(21) Appl. No.: 15/763,410

(22) PCT Filed: Sep. 29, 2016

(86) PCT No.: PCT/EP2016/073340
§ 371 (c)(1),
(2) Date: Mar. 26, 2018

(87) PCT Pub. No.: WO2017/055499
PCT Pub. Date: Apr. 6, 2017

(65) Prior Publication Data

US 2018/0274538 A1 Sep. 27, 2018

(30) Foreign Application Priority Data

Oct. 2, 2015 (DE) ..... 102015116770.0

(51) Int. Cl.
*F04C 2/356* (2006.01)
*F04C 14/02* (2006.01)
*F04C 14/04* (2006.01)

(52) U.S. Cl.
CPC ..... *F04C 2/3568* (2013.01); *F04C 14/02* (2013.01); *F04C 14/04* (2013.01); *F04C 2240/20* (2013.01); *F04C 2240/30* (2013.01)

(58) Field of Classification Search
CPC .. F01C 21/0881; F01C 21/0809; F01C 21/10; F04C 2/3568; F04C 14/04;
(Continued)

(56) References Cited

U.S. PATENT DOCUMENTS 1,654,883 A 1/1928 Jaworowski
1,796,535 A 3/1931 Rolaff
(Continued)

FOREIGN PATENT DOCUMENTS

CN 101061316 A 10/2007
CN 101087960 A 12/2007
(Continued)

OTHER PUBLICATIONS

Japanese Office Action for Application 2018-510457 dated Oct. 8, 2019 (along with English translation).
(Continued)

*Primary Examiner* — Mary Davis
*Assistant Examiner* — Paul W Thiede
(74) *Attorney, Agent, or Firm* — Honigman LLP

(57) ABSTRACT

A blocking device for a pump having a rotor that is rotatable about a rotation axis in a pump duct and comprises a rotor hub and a rotor collar that extends from the rotor hub in the radial direction and encircles it in an undulating manner, wherein the blocking device comprises a plurality of blocking elements which are configured to block the pump duct in the axial direction on both sides of the rotor collar, wherein each of the plurality of blocking elements has a slot with a U-shaped sealing profile for abutting against the rotor collar, a sealing face for abutting against the rotor hub, and two contacting faces for abutting against a seat of the pump duct and/or against a contacting face of another blocking element of the plurality of blocking elements, and to a pump having a corresponding blocking device.

6 Claims, 10 Drawing Sheets

(58) Field of Classification Search
CPC .. F04C 15/0042; F04C 2240/20; F04C 14/02; F04C 2240/30; F05C 2201/90
USPC ..... 418/152, 229, 125, 127, 178–179, 418/216–217, 219, 221–223, 228, 418/242–243
See application file for complete search history.

(56) References Cited

U.S. PATENT DOCUMENTS

| | | | | | |
|---|---|---|---|---|---|
| 3,156,158 | A * | 11/1964 | Pamplin | F04C 2/3568 | 418/217 |
| 3,464,362 | A | 9/1969 | Ross | | |
| 4,575,324 | A * | 3/1986 | Sommer | F04C 2/3568 | 418/217 |
| 5,259,244 | A * | 11/1993 | Foran, Jr. | G01F 3/08 | 73/253 |
| 5,980,225 | A * | 11/1999 | Sommer | F04C 2/3568 | 418/104 |
| 7,462,022 | B2 * | 12/2008 | Fromm | F04C 2/3568 | 418/152 |
| 7,866,963 | B2 * | 1/2011 | Ascari | F01C 21/0881 | 418/26 |
| 2018/0306183 | A1 * | 10/2018 | Staedele | F01C 21/10 | |

FOREIGN PATENT DOCUMENTS

| | | | |
|---|---|---|---|
| EP | 1637740 | A1 | 3/2006 |
| EP | 2565454 | A1 | 3/2013 |
| GB | 1467578 | A | 3/1977 |
| JP | 2006144592 | A | 6/2006 |
| JP | 2008-513664 | A | 5/2008 |
| JP | 2008-520898 | A | 6/2008 |
| WO | 2005066500 | A1 | 7/2005 |
| WO | 2006054159 | A1 | 5/2006 |

OTHER PUBLICATIONS

Chinese Office Action for Chinese Application No. 201680056121.5 dated Dec. 2, 2019 along with English translation.
International Search Report for Application PCT/EP2016/073340 dated Dec. 21, 2016.
German Examination Report for Application No. 102015116770.0 dated Jul. 6, 2016.
International Preliminary Report on Patentability for Application No. PCT/EP2016/073340 dated Apr. 3, 2018.
English Translation of Chinese Office Action for Chinese Application 201680056121.5 dated May 27, 2019.
Chinese Office Action for Chinese Application No. 201680056121.5 dated Dec. 21, 2018 along with English translation.
Chinese Office Action for Chinese Application 201680056121.5 dated May 27, 2019, along with English translation of cover letter only.
Brazilian Office Action for Application BR112018003620-0 dated Jul. 1, 2020 along with partial English translation.
German Examination Report for Application 102015116770.0 dated Feb. 15, 2021 along with English translation.
European Office Action for Application No. 16774669.2 dated Nov. 11, 2020.

* cited by examiner

PUMP INCLUDING A ROTOR AND A PLURALITY OF BLOCKING DEVICE ELEMENTS FOR BLOCKING A PUMP DUCT

TECHNICAL FIELD

The invention relates to a pump having a rotor that is rotatable about a rotation axis and comprises a rotor hub and a rotor collar that extends from the rotor hub in the radial direction and encircles it in an undulating manner.

BACKGROUND

Such pumps are known as sinusoidal pumps. In a pump duct, a fluid to be pumped is pumped from an inlet to an outlet by rotation of the rotor. A blocking device is provided which prevents the fluid to be pumped from being transported back from the outlet to the inlet. The blocking device has a blocking element which comprises the rotor collar and blocks the pump duct in the axial direction on both sides of the rotor collar. The blocking element is mounted in a guide which allows a one-dimensional movement in the axial direction in a manner corresponding to the rotor collar encircling the rotor hub in an undulating manner.

SUMMARY

A blocking device according to the invention is provided for a pump having a rotor that is rotatable about a rotation axis in a pump duct and comprises a rotor hub and a rotor collar that extends from the rotor hub in the radial direction and encircles it in an undulating manner. The blocking device comprises a plurality of blocking elements which are configured to block the pump duct in the axial direction on both sides of the rotor collar. Each of the plurality of blocking elements has a slot with a U-shaped sealing profile for abutting against the rotor collar, a sealing face for abutting against the rotor hub, and two contacting faces for abutting against a seat of the pump duct and/or against a contacting face of another blocking element of the plurality of blocking elements. The plurality of blocking elements form a plurality of sealing lines on the rotor, with the result that the sealing action of the blocking element is improved. Since the blocking elements can abut against one another via the contacting faces, complex mounting of the different blocking elements is not necessary.

Preferably, an odd number of blocking elements are provided. In this way, a middle blocking element can define a central axis or plane, relative to which the further blocking elements are arranged.

At least two blocking elements can each be formed in a uniform manner. As a result of the use of uniform blocking elements, the design of the blocking device is simplified and assembly errors can be prevented and the production costs can be reduced. Preferably, all of the blocking elements are formed in a uniform manner. It is also possible for example for two respective blocking elements to be formed in a uniform manner and to be mounted in different orientations in the blocking device, thereby allowing for example a symmetrical configuration of the blocking device.

According to a first preferred embodiment, the blocking elements each have parallel contacting faces. In this way, the blocking device can be configured in a compact manner. Furthermore, this allows for example employment of the blocking device according to the invention in known pump housings.

According to an alternative embodiment, the blocking elements can each have contacting faces which are arranged at an angle and are each parallel to the radial direction of the rotor. This simplifies the geometry of the blocking elements and of the sealing faces and profiles, since blocking elements abutting against one another are each arranged in the radial direction of the rotor.

Preferably, the blocking elements each have a sealing profile which comprises a sealing lip extending in the radial direction of the rotor. This allows a good sealing function of the respective blocking elements.

The invention furthermore relates to a pump having a rotor that is rotatable about a rotation axis and comprises a rotor hub and a rotor collar that extends from the rotor hub in the radial direction and encircles it in an undulating manner, a pump housing having a pump duct which connects a first inlet/outlet space to a second inlet/outlet space, and an above-described blocking device.

BRIEF DESCRIPTION OF THE DRAWINGS

Further features and advantages of the invention can be gathered from the following description and from the drawings, to which reference is made. In the drawings.

DETAILED DESCRIPTION

Figure 1:
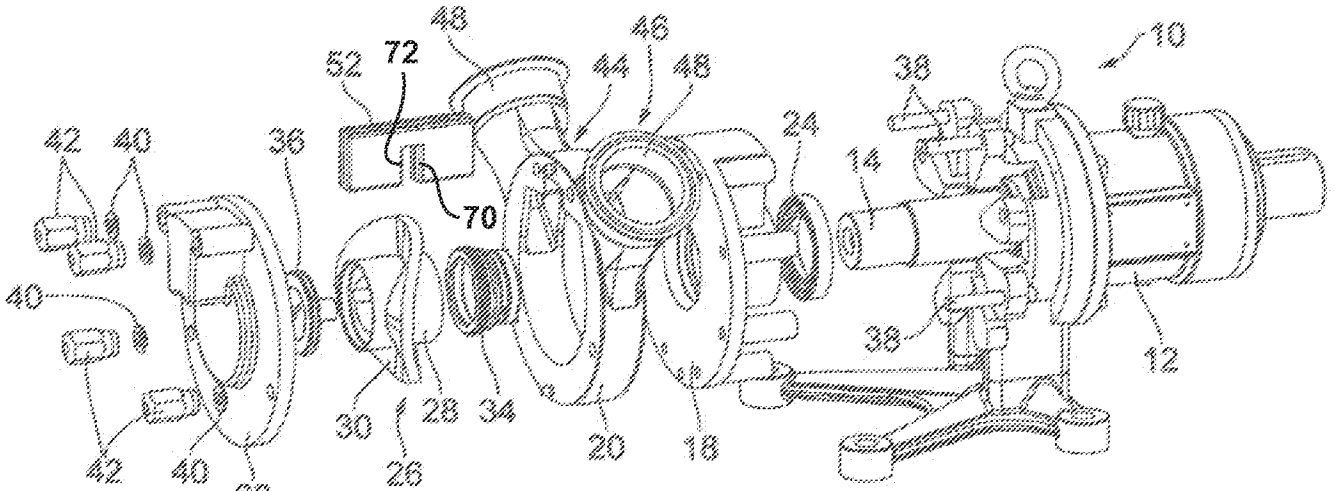
FIG. 1 shows a pump according to the invention in an exploded perspective view having a blocking device according to the invention.
Figure 2:
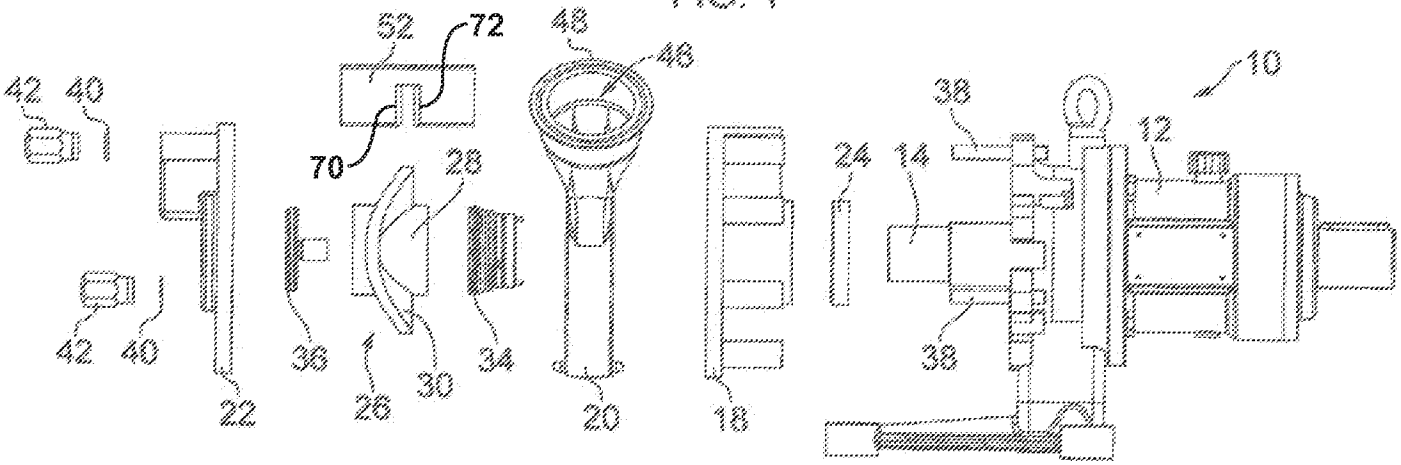
FIG. 2 shows the pump from FIG. 1 in an exploded side view.

FIGS. 1 and 2 each show a pump 10 in an exploded view. The pump 10 comprises a shaft mounting unit 12 which supports a shaft 14. Attached to the shaft mounting unit 12 is a pump housing 16 having a first axial housing component 18, a central annular housing component 20 and a second axial housing component 22.

Provided between the first axial housing component 18 and the shaft mounting unit 12 is a sealing element 24.

The shaft 14 projects into the pump housing 16 in a manner supported on one side. A rotor 26 comprises a rotor hub 28 and a rotor collar 30 that extends from the rotor hub 28 in the radial direction and encircles it in an undulating manner. The rotor 26 is fastened to the shaft 14 via a fastening bolt 36. The one-sided support allows a simple configuration of the pump housing 16, since it is in particular not necessary to support the shaft 14 in the second axial housing component 22. Some other kind of support of the shaft 14, for example a support on both sides, can also be provided.

In the following text, references to an axial direction relate to the rotation axis of the rotor 26 and references to a radial direction relate to a corresponding radial direction centered on the rotation axis. "Axially rearward" relates to the direction pointing towards the shaft mounting unit 12 and "axially forward" relates to the direction pointing towards the pump housing 16. The first axial housing component 18 is thus the axially rear housing component and the second axial housing component 22 is thus the axially front housing component.

Provided between the rotor 26 and the first axial housing component 18 is a mechanical face seal 34. Instead of the mechanical face seal, some other sealing element can also be provided.

The mounting of the shaft 14, the sealing element 24 and the mechanical face seal 34 and the fastening of the rotor 26 to the shaft 14 can also be configured in some other manner.

In the embodiment shown, the pump housing 16 is held together via four bolts 38, washers 40 and nuts 42, wherein the bolts 38 each extend from the shaft mounting unit 12 through all three housing components 18, 20, 22. However, some other fastening method can also be provided. For example, independent fastening of the housing components 18, 20, 22 to one another and of the pump housing 16 to the shaft mounting unit 12 can be provided or independent fastening of the second axial housing component 22 can be provided. This allows modular assembly and disassembly of the pump 10. Alternative ways of fastening the housing components 18, 20, 22 can also be provided. For example, the housing component 18 can be fastened to the shaft mounting unit 12 and the housing components 20 and 22 can be fastened to the housing component 18 via grub screws in the housing component 18.

The central annular housing component 20 has a first inlet/outlet space 44 and a second inlet/outlet space 46, which are each formed with a connection element 48 for connection to a pipeline.

A blocking device 50 comprises a plurality of blocking elements 52 and is configured to block a pump duct in the axial direction on both sides of the rotor collar 30. Each of the plurality of blocking elements 52 has a slot 72 with a U-shaped sealing profile 70 for abutting against the rotor collar 30, a sealing face 68 for abutting against the rotor hub 28, and two contacting faces 62, 66 for abutting against a seat of the pump duct and/or against a contacting face of another blocking element 52 of the plurality of blocking elements 52.

Figure 3:
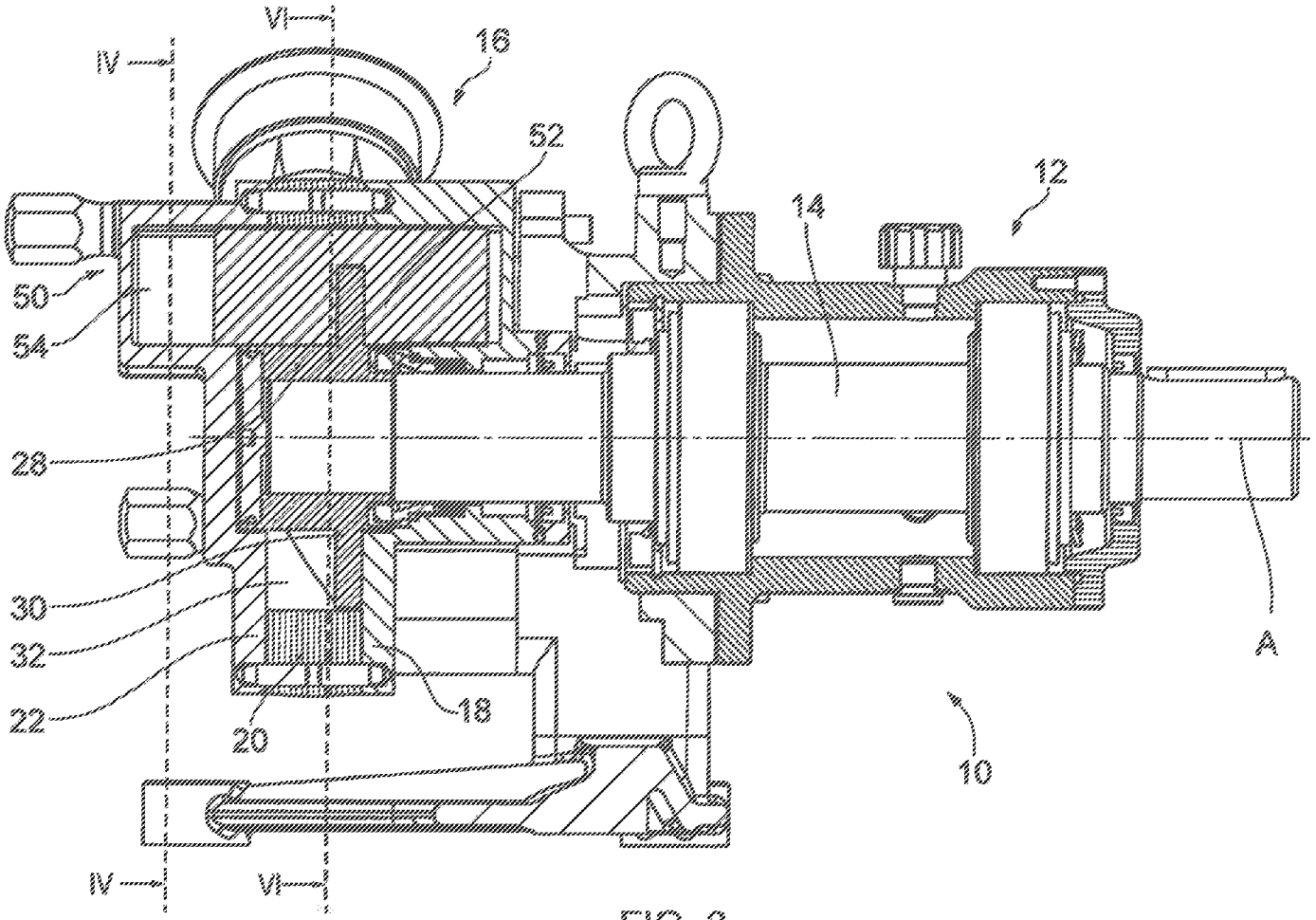
FIG. 3 shows a sectional view of the pump from FIG. 1 in the axial direction.

FIG. 3 shows the pump 10 in a sectional view on a section plane perpendicularly through the rotation axis A of the rotor 26 and the shaft 14. The housing components 18, 20 and 22 form a pump duct 32 together with the rotor hub 28, said pump duct 32 extending annularly around the rotor hub 28. The rotor collar 30 divides the pump duct 32 into various fluid chambers 55 by way of its undulating shape, wherein the radially outer end of the undulating rotor collar 30 adjoins the radial outer wall, formed by the annular housing component 18, of the pump duct 32 in a sealing manner.

The blocking device 50 is arranged in an upper sector, in the embodiment shown, of the pump duct 32. Each of the blocking elements 52 abuts in a sealing manner against the two axial side faces of the rotor collar 30 and against the rotor hub 28. Upon rotation of the rotor 26, the blocking elements 52 can each move independently of one another in the axial direction within a chamber 54 as per the undulating shape of the rotating rotor collar 30.

The chamber 54 is formed by the pump housing 16 in the embodiment shown and has a seat 60 which forms the transition between the chamber 54 and the annular pump duct 32.

Figure 4:
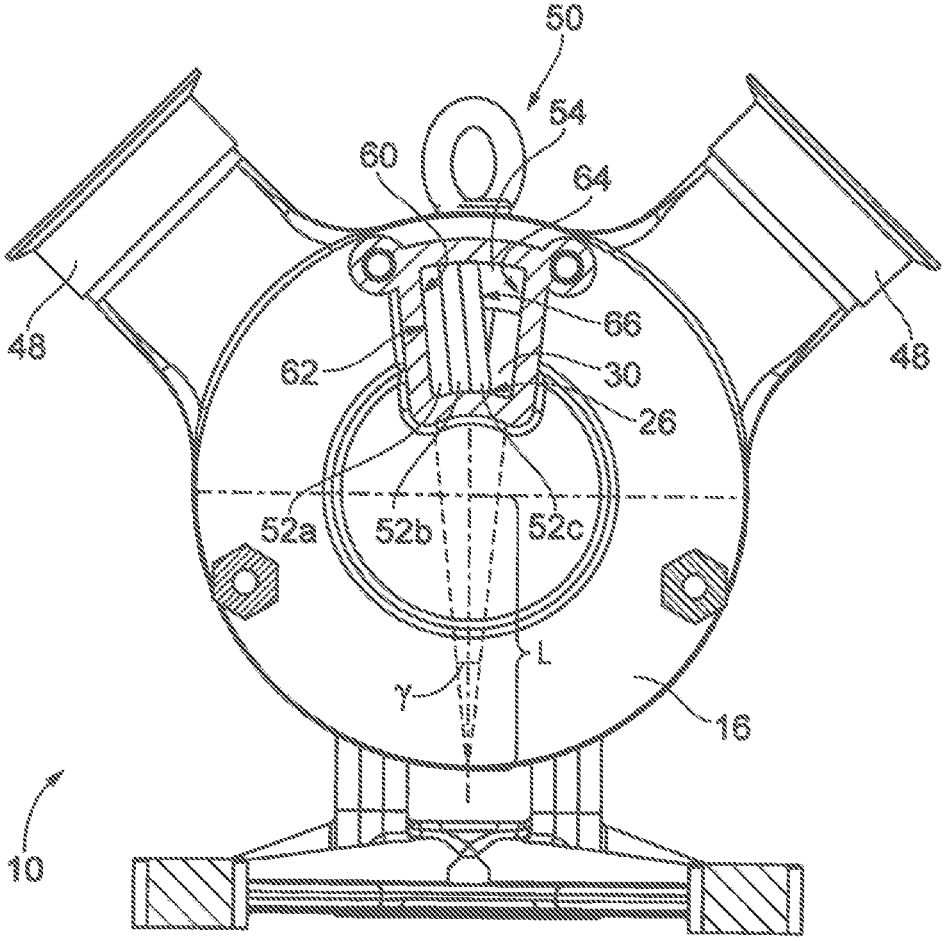
FIG. 4 shows a sectional view of the pump from FIG. 3 on the section plane IV-IV.

FIG. 4 shows a section through the chamber 54 of the pump 10 on the section plane IV-IV in FIG. 3 in the case of an anticlockwise direction of rotation of the rotor 26.

A first blocking element 52*a* abuts against the seat 60 of the chamber 54 with a first contacting face 62 in every axial position, and abuts against the rotor collar 30 with the U-shaped sealing profile and against the rotor hub 28 with the sealing face 68. A second blocking element 52*b* abuts against the second contacting face of the first blocking element 52*a* with a first contacting face and forms a second sealing line on the rotor collar 30 and the rotor hub 28 with the U-shaped sealing profile and the sealing face 68. A third blocking element 52*c* abuts against the second contacting face of the second blocking element 52*b* with a first contacting face and forms a third sealing line on the rotor collar 30 and the rotor hub 28 in an analogous manner. The plurality of blocking elements 52 therefore block the annular pump duct 32 and prevent the fluid to be pumped from being transported back through the annular pump duct 32.

The second contacting face 66 of the third blocking element 52*c* is configured, in the embodiment shown, to abut against a second seat 64 in a second operating direction, in which the rotor rotates clockwise, and thus to block the annular pump duct. This is described further below in conjunction with FIG. 5.

An exchange duct 58 is formed within the chamber 54 and allows fluid to flow in the axial direction between the axially front fluid chamber and the axially rear fluid chamber. In this way, compression of the fluid by a change in volume during an axial movement of the blocking element and the rotor collar is avoided.

It is also possible for the blocking elements 52 to form an exchange duct 58 which extends in the axial direction between an axially front fluid chamber 55 and an axially rear fluid chamber 55 on the opposite side of the rotor collar 30. This can be formed for example as a groove in one or more blocking elements or between two contacting faces, abutting against one another, of two blocking elements 52.

The chamber 54 has four inner walls. A radially internal wall of the chamber 54 is formed in the shape of a circular arc about the rotation axis of the rotor 26 axially on both sides of the rotor 26 and has the same radius as or a slightly smaller radius than the rotor hub 28 in order to ensure a good fit of the blocking elements 52 on the rotor hub 28.

A radially external wall of the chamber 54 has a profile that is in the shape of a circular arc about the rotation axis of the rotor 26. It is also possible for the radially external wall of the chamber 54 to be formed such that it is spaced apart from the blocking elements 52, such that the fluid to be pumped on the pressure side can pass between the radially external wall of the chamber 54 and the blocking elements 52 and thus presses the blocking elements 52 against the rotor hub 26.

In the circumferential direction, the chamber 54 is formed by two flat walls that are located in the circumferential direction and each surround the flow duct in a U-shaped manner and form a first and second seat 60, 64 for the blocking elements 52 in the embodiment shown. In this way, the pump 10 can be operated on both sides.

In the embodiment shown, the blocking elements 52 are each formed with contacting faces 62, 66 that extend in a parallel manner and are each spaced apart from one another by a thickness d of each particular blocking element 52. The two flat walls that are located in the circumferential direction are formed in this embodiment such that the blocking element 52 can be displaced by an angle γ in the circumferential direction within the chamber 54 between the first and second seats 60, 64. In the embodiment shown, the angle γ is 10°. The angle y can be in a range from 5° to 40°, wherein the angle is preferably in a range from 5° to 20°.

To this end, the two flat walls that are located in the circumferential direction are in the radial direction with respect to a center point which is shifted on a central axis of the pump by the distance L, wherein L=(D/2)/sin(γ/2) and D is the overall thickness of all the blocking elements 52 (in this case D=3d). In this way, the centerline of the middle blocking element 52*b* is in each case oriented in the radial direction with respect to the rotation axis A when the first or second blocking element 52*a* or 52*b* abuts respectively against the first or second seat 60, 64 of the chamber 54 by way of its contacting faces 62 or 66. The first and second seats are thus each formed in planes which are oriented at the angle y to one another.

In order to compensate for a change in volume on account of the axial movement of the rotor collar 30 and of the blocking elements 52, the exchange duct 58 is formed in the blocking device 50. This allows a flow of fluid to be pumped between the axially front fluid chamber and the axially rear fluid chamber within the blocking device. Therefore, a compact configuration of the blocking device 50 is allowed, since the chamber 54 of the blocking device does not have to be connected to one of the inlet/outlet spaces 44, 46.

In the chamber 54, the ratio of the area of the axial flow cross section of the exchange duct 58 to the axial projection area of the rotor collar 30 and of those parts of the blocking elements 52 that project beyond the rotor collar is preferably at least 0.2 and is for example in the range from 0.2 to 0.6. This allows sufficient volume compensation with a compact construction of the blocking device 50.

Figure 5:
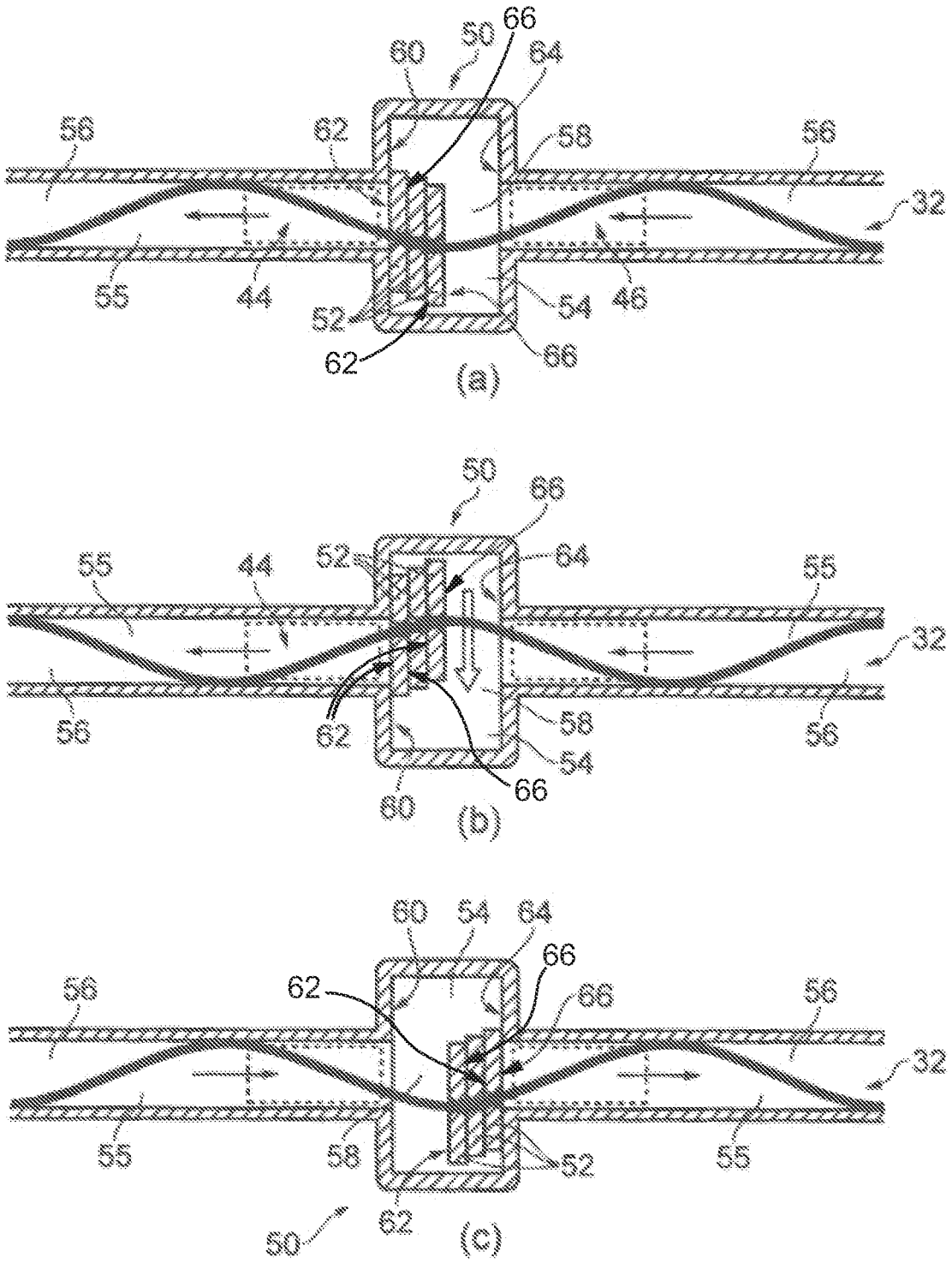
FIG. 5 shows schematic views of the pump duct of a pump according to the invention.

Sub-figures (a) to (c) of FIG. 5 each show a schematic view of the pump duct 32 with the rotor 26 and the blocking device 50.

In the embodiment shown, the pump duct is formed by the pump housing 16 itself, i.e. from the three housing components 18, 20, 22. In this way, as can be seen in FIG. 5, installation space can be saved on in the region of the pump duct. Furthermore, the assembly and disassembly and also cleaning of the pump 10 are simplified.

The inlet and the outlet of the fluid to be pumped takes place via radially external inlet/outlet spaces 44, 46 which are shown by way of dashed lines. In the embodiment shown, the inlet/outlet spaces are formed in a symmetrical manner to one another, in order to allow bidirectional operation of the pump 10.

The pump duct 32 is formed in an annular manner and extends with a constant cross section from the first radially external inlet/outlet space 44 to the second radially external inlet/outlet space 46. The blocking device 50 is arranged in the annular pump duct 32 between the two inlet/outlet spaces 44, 46 and prevents a backflow of the fluid to be pumped counter to the operating direction of the pump. In the region of the radially external inlet/outlet spaces 44, 46, fluid to be pumped can flow in the radial direction into the fluid chambers 55 formed by the rotor 26 and the pump housing. When the rotor 26 is rotated, the fluid chambers are moved further along the annular pump duct 32, wherein one respective fluid chamber 56 closes and allows fluid transport in the pumping direction. On the outlet side of the pump 10, the fluid chambers move into the region of the blocking device 50, which blocks the pump duct 32, with the result that the fluid to be pumped flows in the radial direction out of the fluid chambers and into the outlet-side radially external inlet/outlet space.

The pump 10 is therefore a positive displacement pump which transports a trapped fixed volume in the closed fluid chamber 56.

The function of the blocking device 50 is explained in the following text. The blocking device 50 is arranged between the first inlet/outlet space 44 and the second inlet/outlet space 46 and comprises a plurality of blocking elements 52 which block the pump duct 32 in the axial direction on both sides of the rotor collar 30. In the embodiment shown in FIG. 5, three blocking elements 52 are provided.

The blocking device 50 is configured for bidirectional operation of the pump 10. To this end, the blocking device 50 has a first seat 60 for the first blocking element 52*a* on the side of the first inlet/outlet space 44, against which the first blocking element 52*a* abuts by way of a first contacting face 62 in a first operating direction for pumping from the first inlet/outlet space 44 to the second inlet/outlet space 46, see FIGS. 5(*a*) and (*b*).

The blocking device also has a second seat 64 for the third blocking element 52*c* on the side of the second inlet/outlet space 46, against which the third blocking element 52*c* abuts by way of a second contacting face 66 in a second operating direction for pumping from the second inlet/outlet space 46 to the first inlet/outlet space, see FIG. 5(*c*).

The spacing between the first seat 60 and the second seat 64 in the circumferential direction is greater than the spacing between the first contacting face 62 and the second contacting face 66 in the circumferential direction.

When the operating direction of the bidirectional pump 10 is changed, all three blocking elements 52 move from the first seat 60 to the second seat 64 such that the third blocking element 52*c* abuts against the second seat 64 by way of its second contacting face 66, the second blocking element 52*b* abuts against the first contacting face, facing the first inlet/outlet space 44, of the third blocking element 52*c* via its second contacting face facing the second inlet/outlet space 46, and the first blocking element 52*a* abuts against the first contacting face, facing the first inlet/outlet space 44, of the second blocking element 52*b* via its second contacting face facing the second inlet/outlet space 46, and the respectively other contacting face 66, 62 is spaced apart from the pump housing 16. Furthermore, the resistance in the fluid to be pumped is reduced and thus the pressure force from the blocking elements to the rotor is reduced, with the result that the frictional forces and thus also the wear to the blocking elements 52 are reduced.

As can clearly be seen in FIGS. 5(*a*) and (*b*), the volume in chamber 54 changes when the rotor 26 is rotated (from right to left in the drawing) on account of the undulating shape of the rotor collar and the blocking elements 52 moving in the axial direction. Since the blocking device 50 is arranged between the two inlet/outlet spaces 44, 46, it is at least sometimes possible for an axial portion of the chamber 54 of the blocking device 50 not to be connected to the associated outlet space 44, 46.

In order to allow this change in volume to be compensated, the exchange duct 58 is formed between the axially front fluid chamber and the axially rear fluid chamber. A fluid flow is shown in the axial direction by the arrow in FIG. 5(*b*).

Figure 6:
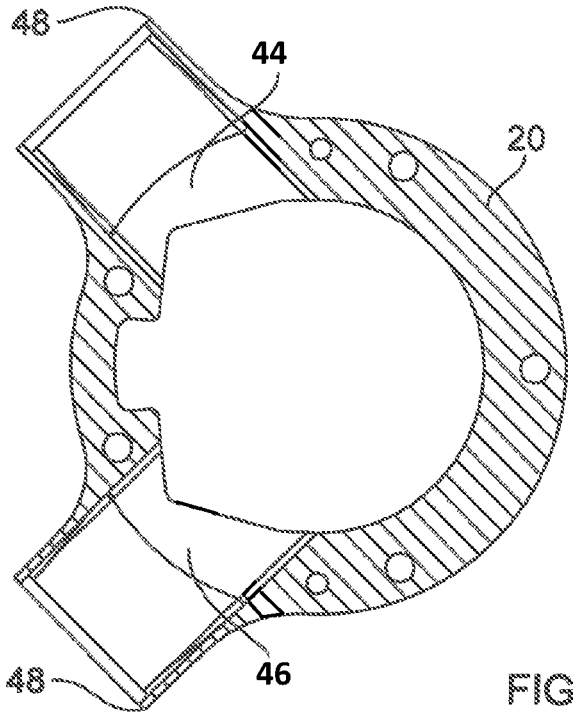
FIG. 6 shows a sectional view of the central housing component of the pump from FIG. 3 on the section plane VI-VI.

FIG. 6 shows a sectional view through the central housing component 20 in accordance with the section plane VI-VI in FIG. 3. The housing component 20 is arranged such that the blocking device 50 with the chamber 54 is arranged in a manner rotated by 90° compared with the embodiment shown in FIG. 3, i.e. on the horizontal central axis of the annular pump duct 32. Preferably, the pump 10 is formed such that the pump housing 16 can be attached to the shaft mounting unit 12 at different angles.

The inlet/outlet spaces 44, 46 are formed radially externally on the annular pump duct 32, wherein a first part of the inlet/outlet spaces 44, 46 is formed over the entire axial height of the pump duct in that the central housing component 20 is spaced apart from the pump duct 32 in the radial direction in the region of the inlet/outlet spaces 44, 46. In the embodiment shown, the radial spacing of the housing component 20 narrows in the circumferential direction in the respective end region of the inlet/outlet spaces 44, 46, such that the first part of the inlet/outlet spaces 44, 46 is approximately triangular in axial view. A second part of the inlet/outlet spaces 44, 46 is formed in the housing component 20 and forms a transition to the connection elements 48.

The inlet/outlet spaces 44, 46 are formed in the left-hand upper quadrant and in the left-hand lower quadrant in the housing component 20 in the embodiment shown and each extend as far as the vertical central axis of the annular pump duct 32. This allows the emptying of residues from the pump.

Figure 7:
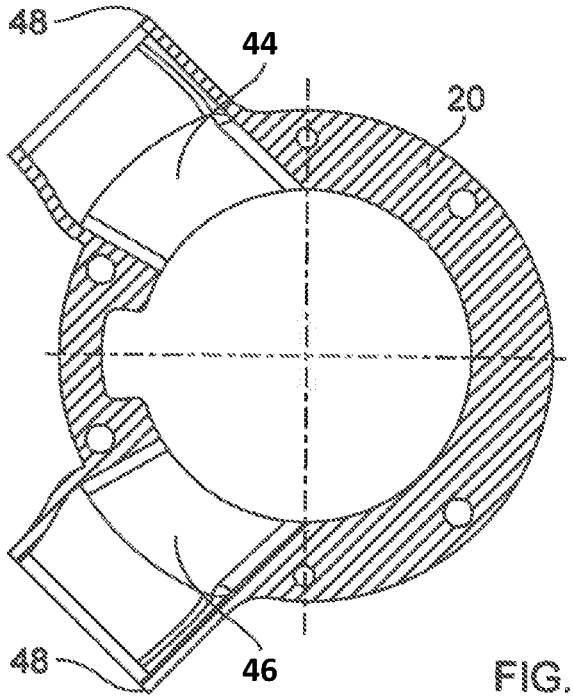
FIG. 7 shows a sectional view of the central housing component according to an alternative embodiment.

FIG. 7 shows a sectional view through the central housing component 20 as per the alternative embodiment. The embodiment differs from the embodiment shown in FIG. 6 in that the housing component 20 is not spaced apart from the pump duct 32 in the radial direction in the region of the inlet/outlet spaces 44, 46.

Figure 8:
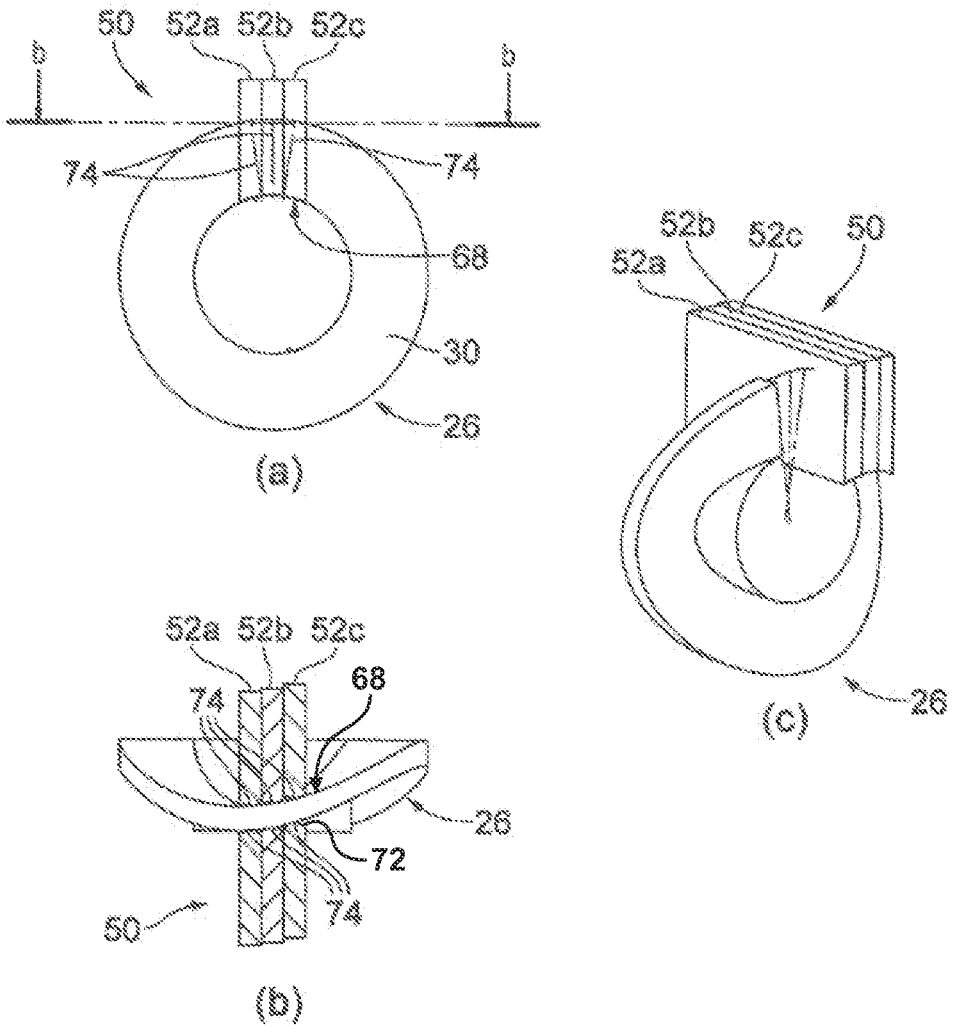
FIG. 8 shows detail views of a blocking element and rotor according to a first embodiment of the invention.

Sub-figure (a) of FIG. 8 shows an axial plan view of the rotor 26 and the blocking elements 52. Sub-figure (b) shows a sectional view through the blocking elements 52 in accordance with the section plane b-b in sub-figure (a), and sub-figure (c) shows a perspective view of the components of sub-figure (a).

As can be seen in sub-FIG. 8(*a*), the first and second contacting faces of the blocking elements 52*a*, 52*b* and 52*c* are each formed in a manner parallel to one another. The middle blocking element 52*b* is formed in a symmetrical manner to its central plane in particular with regard to the sealing face 68 abutting against the rotor hub. The first and third blocking elements 52*a* and 52*c* are each formed in a mirror-symmetrical manner to one another with regard to the central plane of the middle blocking element 52*b*. Since the blocking elements 52*a*, 52*b*, 52*c* are each also formed in a mirror-symmetrical manner to a respective central plane located parallel to the rotor plane, two uniform blocking elements can be used for the two outer blocking elements 52*a* and 52*b*, these being accordingly mounted on the rotor collar 30 in a manner rotated by 180° with respect to one another.

As can be seen in sub-FIG. 8(*b*), the U-shaped sealing profiles 70 on the slot 72 of the blocking elements 52 are each configured as convex sealing lips 74. In order to allow optimal contact of the blocking elements 52 against the rotor collar 30, the sealing lips 74 each extend in the radial direction of the rotor. Thus, the sealing lip 74 of the middle blocking element 52*b* extends parallel to the lateral contacting faces, while the sealing lips 74 of the outer blocking elements 52*a* and 52*c* extend in a manner inclined at an angle to the lateral contacting faces.

The blocking elements 52 can furthermore also each have an inclined face which is directed at least partially in the axial direction and is configured to press the particular blocking element 52 against the rotor hub 28 in the event of an axial movement in the fluid to be pumped. For example, the surface remote from the rotor hub 28 can be formed in a roof-like manner. Alternatively, an inclined face can be formed in a groove in a blocking element 52 or in a groove between two blocking elements 52.

Figure 9:
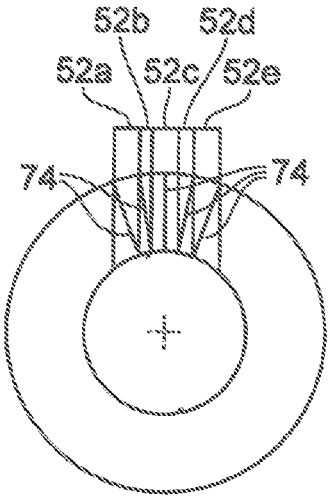
FIG. 9 shows a detail view of a blocking element and rotor according to a second embodiment of the invention.

FIG. 9 shows a second embodiment of a blocking device 50 having five blocking elements 52*a* to 52*e*. In an analogous manner to the preceding embodiment, the first and second contacting faces of each blocking element 52*a* to 52*e* extend parallel to one another. The sealing lip 74 of the middle blocking element 52*c* extends parallel to the contacting faces, while the sealing lips 74 of the outer blocking elements 52*a*, 52*b*, 52*d* and 52*e* each extend in an inclined manner with respect to the contacting faces. In an analogous manner to the preceding embodiment, the blocking elements 52*a* and 52*e* and the blocking elements 52*b* and 52*d* are each formed in a uniform manner. In contrast to the preceding embodiment, the different blocking elements 52*a* to 52*e* are formed with different thicknesses, i.e. the outer blocking elements have a greater spacing between the contacting faces than the inner blocking elements. In this way, installation space can be saved for the inner blocking elements, in the case of which the sealing lip extends parallel or at a small angle to the contacting faces, while a correspondingly greater thickness is required for the outer blocking elements 52*a* and 52*e* on account of the profile of the sealing lips 74 with a relatively large angle to the contacting faces.

Figure 10:
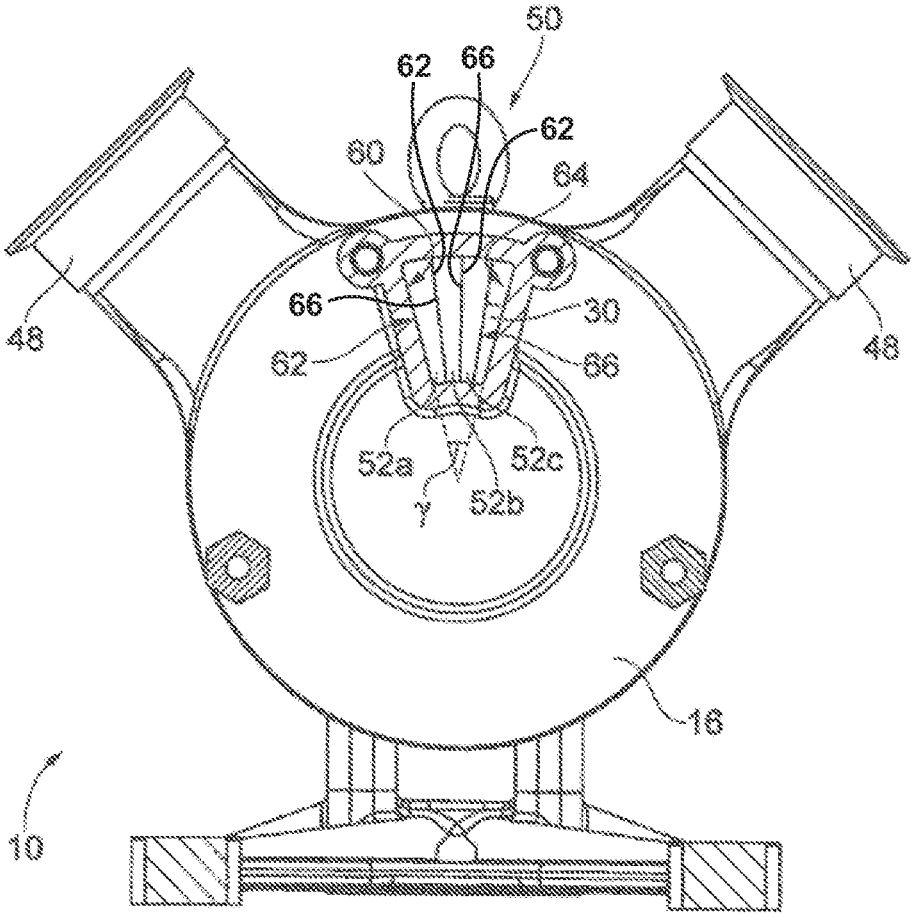
FIG. 10 shows a sectional view of a pump having a blocking element according to a third embodiment of the invention.

FIG. 10 shows a third embodiment of a blocking device 50, in which the blocking elements 52 are configured such that the first and second contacting faces 62, 66 are arranged at an angle and each extend in the radial direction of the rotor 26. In this way, all of the blocking elements 52 can be formed in an identical manner, with the result that the production costs are reduced and the assembly of the pump and the replacement of blocking elements 52 are simplified.

In FIG. 10, the two flat walls of the chamber 54 that are located in the circumferential direction are likewise arranged in the radial direction of the rotor 26. The first and second seats are thus each formed in planes which are oriented at the angle $\gamma$ to one another.

The pump housing and the rotor are otherwise formed in an analogous manner to the preceding embodiments.

Alternatively, it is also possible for the two walls that are located in the circumferential direction and the contacting faces 62, 66 of the blocking elements 52 to each have generally cylindrical shapes, in particular curved shapes, that are coordinated with one another. Furthermore, the outer contacting faces 62, 66, in the circumferential direction, of the respectively outer blocking elements 52, which are configured to abut against the first and second seats 60, 64, can have a different shape from the contacting faces by way of which the blocking elements 52 abut against one another, for example by way of a wedge shape or arcuate shape of the blocking element 52.

The shapes of the two walls that are located in the circumferential direction and of the contacting faces 62, 66 of the blocking elements 52 can be selected such that the blocking elements are pressed against the rotor hub 26 by the pressure difference when the pump is in operation.

Figure 11:
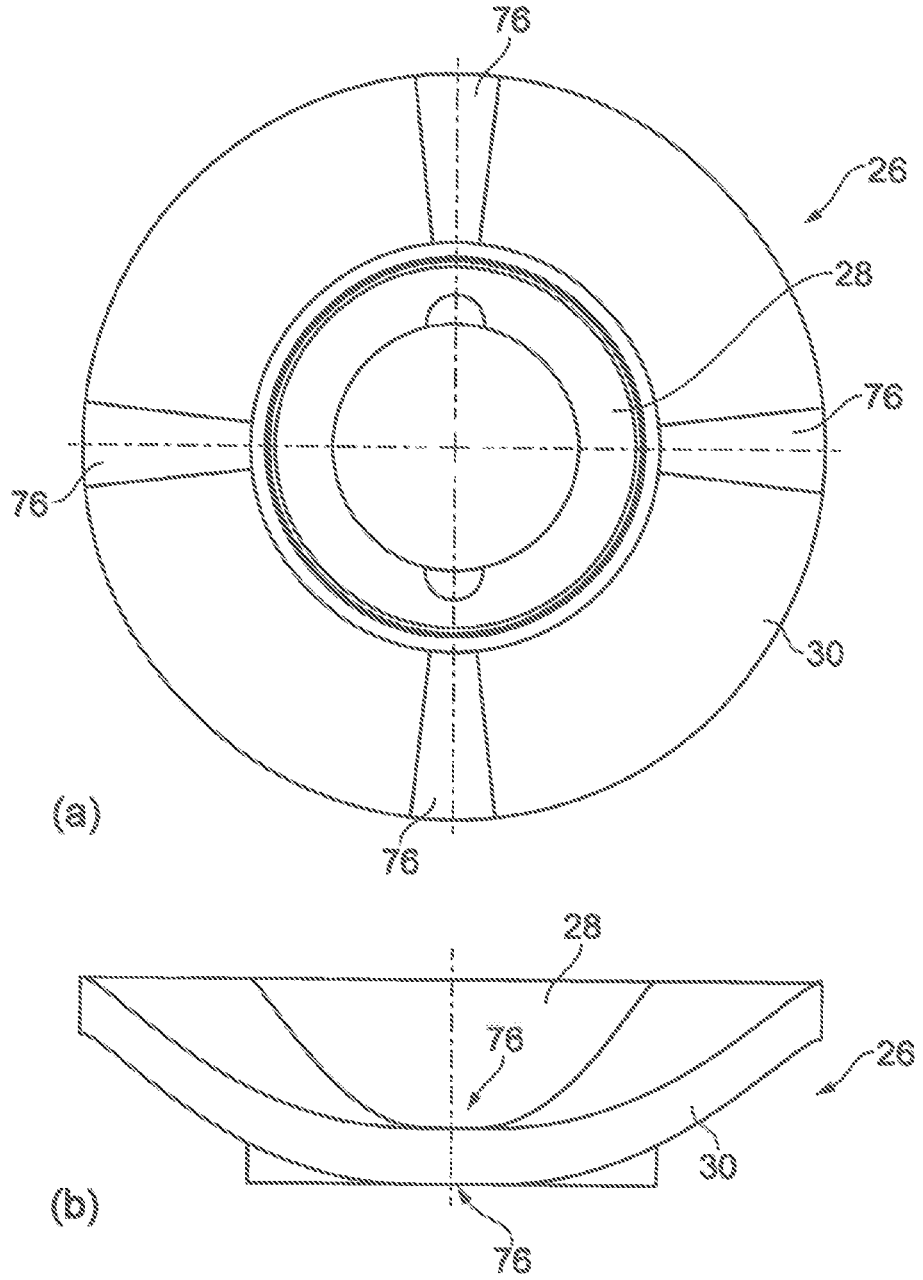
FIG. 11 shows detail views of a rotor of the pump from FIG. 1.

Sub-figures (a) and (b) of FIG. 11 each show a view of the rotor 26, wherein sub-figure (a) shows an axial plan view of the rotor 26 and sub-figure (b) shows a radial plan view of the rotor 26.

The rotor collar 30 extends in the radial direction from the rotor hub 28 and encircles the rotor hub 28 in an undulating manner. In the embodiment shown, the rotor collar 30 is in the two axial extreme positions at two opposite points each. Thus, the rotor collar forms two fluid chambers on each of the two axial sides of the rotor collar.

In the embodiment shown, the rotor collar 30 extends in a flattened manner at the axial extreme positions 76, with the result that the sealing is improved at the axial end faces of the pump duct 32, which are formed by the two axial housing components 18 and 22. This allows in particular an enlargement of a gap between the rotor collar 30 and the axial end faces of the pump duct 32. This allows the pump to generate greater pressures with larger gap dimensions.

In the embodiment shown, the rotor 26 is produced from an anti-seizure alloy.

Preferably, a sealing face, in the form of a circumferential groove, for a mechanical seal is provided in the rotor hub 26.

It is also possible for other rotor shapes to be used for the pump.

Figure 12:
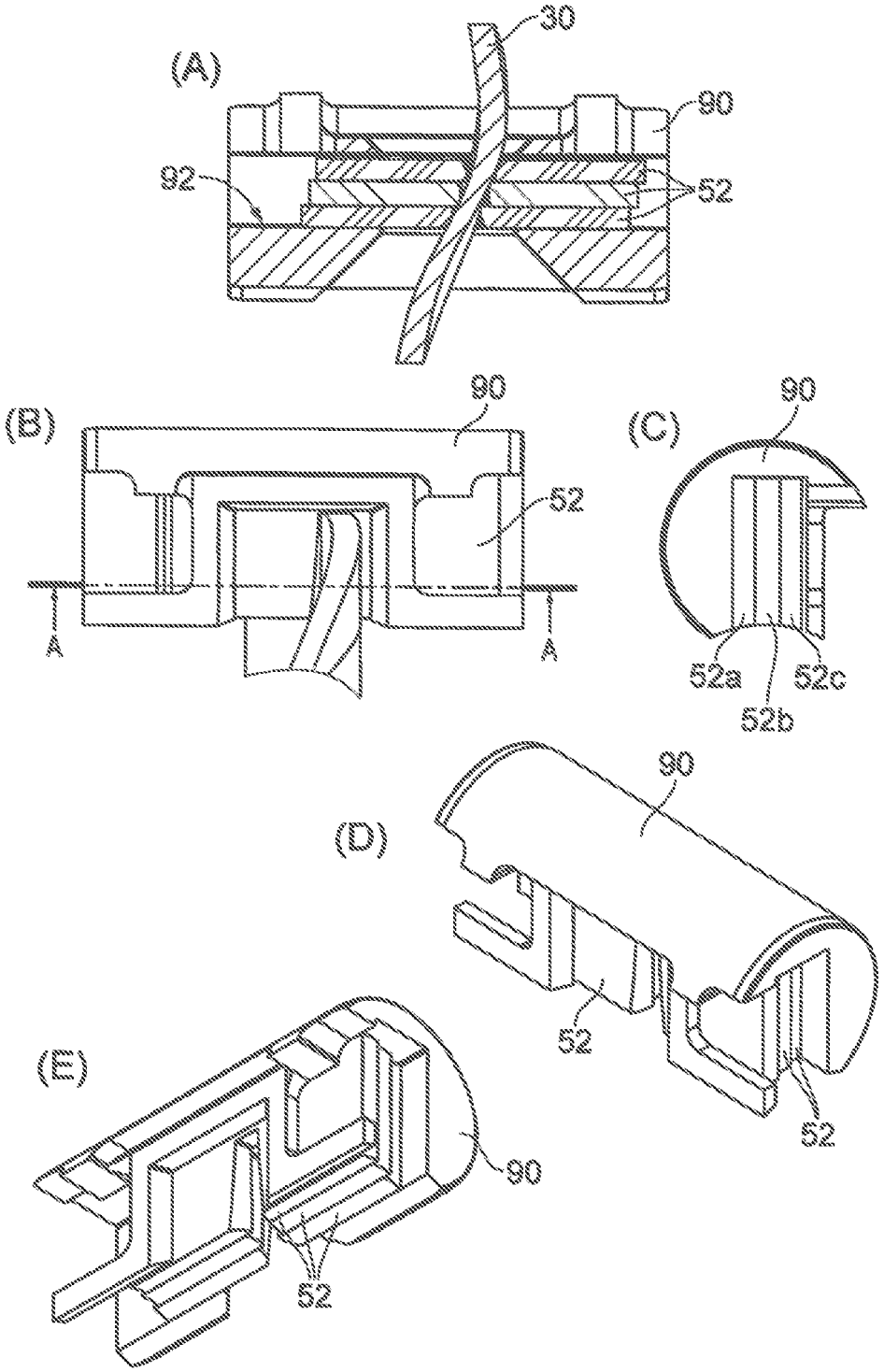
FIG. 12 shows views of the blocking device according to the invention in a pump having a guide component.

The pump housing can also be formed in some other manner. For example, the blocking device 50 can also be provided in a known pump housing which provides only one-sided pumping operating. The plurality of blocking elements 52 can in particular also be guided in a guide which allows only a unidirectional movement in the axial direction. In FIG. 12, a blocking device 50 according to the invention is in a guiding component 90 which allows a linear movement of the blocking elements 52 in the axial direction and forms a seat 92 for one of the blocking elements 52. The blocking elements are formed in an analogous manner to the embodiment shown in FIG. 4 and FIG. 8. FIG. 12 (A) shows a sectional view through the blocking device 50. FIG. 12 (B) shows a view of the high-pressure side of the pump. FIG. 12 (C) shows a view in the axial direction, wherein the high-pressure side of the pump is arranged on the right and the low-pressure side of the pump is arranged on the left. FIGS. 12 (D) and 12 (E) each show perspective views.

The invention claimed is:

1. A blocking device for a pump, said pump including a rotor that is rotatable about a rotation axis in a pump duct and including a rotor hub and a rotor collar that extends outwardly from the rotor hub and encircles the rotor hub in an undulating manner, said blocking device comprising:

a plurality of blocking elements which are configured to block the pump duct in an axial direction on both sides of the rotor collar, wherein each of the plurality of blocking elements has a slot with a U-shaped sealing profile for abutting against the rotor collar, a sealing face for abutting against the rotor hub, and two contacting faces, wherein each contacting face is adapted for abutting either against a seat of the pump duct or against a contacting face of another blocking element of the plurality of blocking elements, wherein each of the plurality of blocking elements is wedge-shaped, and wherein each contacting face of each blocking element of the plurality of blocking elements is disposed on a plane that corresponds with one of a plurality of radial directions of the rotor.

2. The blocking device according to claim 1, wherein an odd number of the plurality of blocking elements are provided.

3. The blocking device according to claim 1, wherein two blocking elements of the plurality of blocking elements are each formed to be uniform in shape to each other.

4. The blocking device according to claim 1, wherein the plurality of blocking elements each have a sealing profile which comprises a sealing lip extending along at least one of the plurality of radial directions of the rotor.

5. A pump comprising:

a rotor that is rotatable about a rotation axis and comprises a rotor hub and a rotor collar that extends outwardly from the rotor hub and encircles the rotor hub in an undulating manner;

a pump housing having a pump duct which connects a first inlet/outlet space to a second inlet/outlet space; and a blocking device comprising:

a plurality of blocking dements which are configured to block the pump duct in an axial direction on both sides of the rotor collar, wherein each of the plurality of blocking dements has a slot with a U-shaped sealing profile for abutting against the rotor collar, a sealing face for abutting against the rotor hub, and two contacting faces, wherein each contacting face is adapted for abutting either against a seat of the pump duct or against a contacting face of another blocking dement of the plurality of blocking dements, wherein each of the plurality of blocking elements is wedge-shaped and wherein each contacting face of each blocking element of the plurality of blocking elements is disposed on a plane that corresponds with one of a plurality of radial directions of the rotor.

6. A pump comprising:

a rotor rotatable about a rotation axis in a pump duct having an inlet and an outlet;

the rotor having a rotor hub and a rotor collar that extends out from the rotor hub in a radial direction of the rotor, wherein the rotor collar encircles the rotor hub in an undulating manner forming pump chambers with the pump duct;

a blocking device comprising:

a plurality of blocking elements disposed in a blocking element chamber, wherein seats are formed in a transition between the blocking element chamber and the pump duct, each blocking element of the plurality of blocking elements includes:

a slot with a U-shaped sealing profile, wherein the U-shaped sealing profile is fitted to and sealingly abutting against the rotor collar, a sealing face extending in an axial direction of the rotor and sealingly abutting against the rotor hub, and two opposing contacting faces extending in the axial direction of the rotor, wherein the two opposing contacting faces having different angles thereby forming a wedge-shape, wherein each wedge-shaped blocking element of the plurality of wedge-shaped blocking elements is configured to independently move axially within the blocking element chamber and one of the plurality of wedge-shaped blocking elements seals against one of the seats to block fluid from the inlet to the outlet during operation of the pump; and wherein each contacting face of the two opposing contacting faces is either configured to abut against one of the seats of the pump chamber or contacts the contacting face of an adjacent wedge-shaped blocking element of the plurality of wedge-shaped blocking elements.

* * * * *